United States Patent [19]

Bödewein

[11] 4,294,145

[45] Oct. 13, 1981

[54] MACHINE FOR THE CROSSCUTTING OF A WEB CONVEYED AS A MULTI-PLY WEB

[75] Inventor: Jakob Bödewein, Monchen-Gladbach, Fed. Rep. of Germany

[73] Assignee: Jagenberg Werke AG, Dusseldorf, Fed. Rep. of Germany

[21] Appl. No.: 138,775

[22] Filed: Apr. 10, 1980

[30] Foreign Application Priority Data

Apr. 30, 1979 [DE] Fed. Rep. of Germany ..... 2917582

[51] Int. Cl.[3] ..... B26D 1/62

[52] U.S. Cl. ..... 83/302; 83/279; 83/349; 83/438; 83/446; 83/448

[58] Field of Search ..... 83/302, 349, 438, 421, 83/446, 448, 650, 279

[56] References Cited

U.S. PATENT DOCUMENTS

| | | | |
|---|---|---|---|
| 376,025 | 1/1888 | Broussier | 83/302 X |
| 2,011,614 | 8/1935 | Bustamante | 83/302 X |
| 2,261,968 | 11/1941 | Matthews | 83/349 X |

*Primary Examiner*—Frank T. Yost

*Attorney, Agent, or Firm*—Sprung, Felfe, Horn, Lynch & Kramer

[57] ABSTRACT

A machine for the crosscutting of a multi-ply web includes a crosscutter, a guide preceding the crosscutter in the direction of web travel and a feed section disposed between the web guide and the crosscutter preceding the web to the crosscutter which includes a pair of rolls. Differences in sheet lengths of the various plies cut by the crosscutter is compensated by mounting the web guide for pivotable movement as a unit about the axis of one of the two rolls of the feed section and for fixing the web guide in a selected position in the path of motion thereof.

5 Claims, 1 Drawing Figure

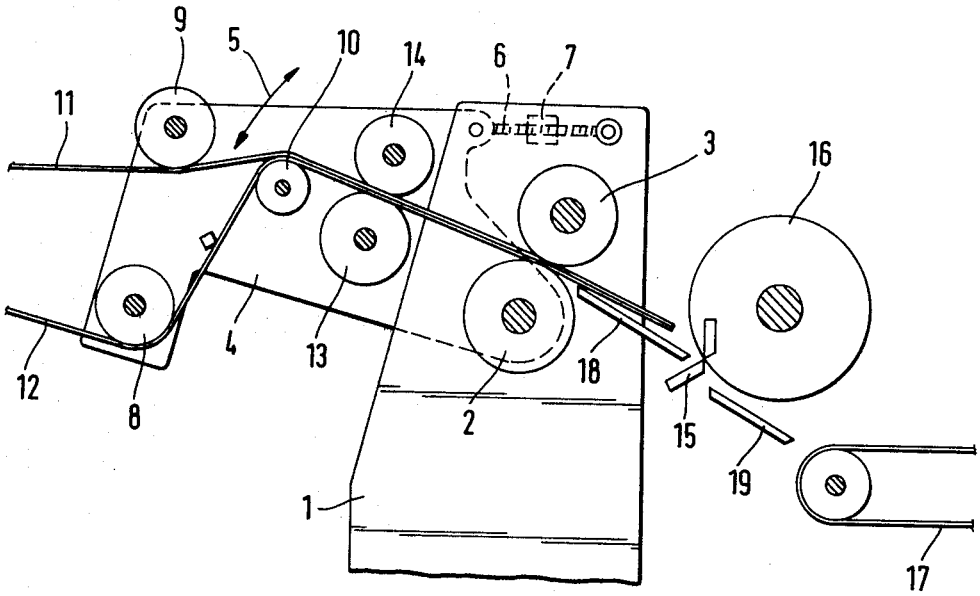
9
5
10
14
6
7
11
3
16
12
8
4
13
2
18
15
19
1
17

MACHINE FOR THE CROSSCUTTING OF A WEB CONVEYED AS A MULTI-PLY WEB

BACKGROUND OF THE INVENTION

The invention relates to a machine for the crosscutting of a web of material, and particularly a paper web, to be conveyed as a multi-ply wed, comprising a crosscutter, and in particular a rotary crosscutter, web guiding means preceding the crosscutter in the direction of web travel, and a feed section consisitng of a pair of rolls and disposed between the web guiding means and the crosscutter.

When a multi-ply web moves between a pair of rolls, there is some shifting of the individual plies relative to one another. The extent to which the various plies shift depends on the nature of the material, for example, its surface roughness, the thickness of the web, and other characteristics. When webs so conveyed are crosscut, sheet-size differences are encountered in the individual sheet packets. This is widely known as the stair-cut effect.

Various measures have been resorted to in order to minimize the shifting of the individual plies. In a prior-art machine of the type outlined above, the feed section comprises special rolls in which a displaceable air cushion is disposed between the hub of the roll and a resilient cylinder. Through meshing gearing, the hub of the roll is joined to the cylinder so as to permit displacement in the radial direction but not tangentially. Because of this special roll design, the rolls are capable of being flattened in the clearance between them. A machine of this type is disclosed in German Pat. No. 1,786,341.

In another prior-art machine, the feed section does not have rolls with resilient cylinders but instead has a pair of conveyor belts which are rearwardly supported on air cushions. A machine of this type is disclosed in German Pat. No. 1,611,768.

Although shifting is less pronounced with these two machines than it is with a machine having a pair of rolls with nonresilient cylinders, these machines fall short of meeting today's requirements.

SUMMARY OF THE INVENTION

The object of the invention is to provide a machine of the type outlined above in which the sheet-sized differences in the sheet packets are smaller than in the machines known up to now.

In accordance with the invention, this object is accomplished with a machine of the type outlined above in that the web guiding means are pivotable as a unit on the axis of one of the two rolls of the feed section and are fixable over their path of motion.

In the invention, the web guiding means are brought into an angular position relative to the feed section in which the stair-cut effect is minimal or is uniformly distributed over the superposed cut edges, and are fixed in that position. For example, when the sheet-size differences are distributed unevenly over the superimposed plies, the web guiding means can be adjusted in one direction or the other to secure that said differences are symmetrical relative to the middle ply. Since pivoting of the web guiding means does not alter the position of feed section and crosscutter relative to each other, the multi-ply web is optimally positioned as it reaches the blades of the crosscutter. If, on the other hand, one roll of the feed section were swung about the other roll for the purpose of balancing out the sheet-size differences, problems would arise at the crosscutter, or further measures would have to be adopted in order to introduce the web optimally into the crosscutter.

In the machine in accordance with the invention, the multi-ply web can simultaneously be slit lengthwise without this requiring much additional equipment. This could be accomplished by adapting the slitter to pivot together with the web guiding means.

BRIEF DESCRIPTION OF THE DRAWING

The invention will now be explained in greater detail with reference to the accompanying drawing, which represents a diagrammatic side elevation of an embodiment.

DETAILED DESCRIPTION OF THE INVENTION

In a stand 1 of the machine there is disposed a feed section consisting of two rolls 2 and 3. The latter are provided with a cover which yields in the radial direction, thus permitting their circumferences to be flattened as a web passes through the clearance between them. In the stand 1, a bracket 4 is mounted to pivot on the shaft of the roll 2. The bracket 4 is formed of two side plates disposed on either side of the stand 1. The bracket 4 can be pivoted in the directions of the double arrow 5 by means of spindles 6 which engage the side plates and turn in nuts 7. These positioning means permit continuous adjustment until the desired angular position is reached.

The bracket 4 carries guide rolls 8, 9 and 10 over which the two paper webs 11 and 12 pass and together are fed to a slitter 13 and 14, also mounted on the bracket 4.

The feed section 2 and 3 is followed, in the direction of web travel, by a crosscutter consisting of a stationary lower blade 15 and a rotating upper cutter roll 16. The cross-cutter 15 and 16, in turn, is followed by a conveyor belt 17. For guidance of the web or of the sheet packets, respectively, between the feed section 2 and 3 and the crosscutter 15 and 16, and between the latter and the conveyor belt 17, sheet-metal guides 18 and 19, respectively, are provided below the lane of web travel.

When during crosscutting in the machine in accordance with the invention the sheet-size differences are too great at the setting of the web guiding means chosen, the positioning means 6 and 7 is actuated to pivot the bracket 4 with the web guiding means 8, 9 and 10 and the slitter 13 and 14 on the shaft of the roll 2 either clockwise or counterclockwise, depending on the side of the sheet packet on which the sheet-size difference are greatest. In this way the sheet-size differences can be balanced out. Since the spatial relationship between the feed-section rolls 2 and 3 and the crosscutter 15 and 16 is not altered, assurance is provided that the web will enter the crosscutter optimally positioned. The invention thus permits the rapid reduction of sheet-size differences without an elaborate apparatus being required therefor.

It will be appreciated that the instant specification and claims are set forth by way of illustration and not limitation, and that various changes and modifications may be made without departing from the spirit and scope of the present invention.

What is claimed is:

1. A machine for the crosscutting of a multi-ply web, comprising: a crosscutter; means preceding the crosscutter in the direction of web travel for guiding the plies of the web; means disposed between the web guiding means and the crosscutter for feeding the multi-ply web to the crosscutter comprising a pair of rolls; and means for compensating for the differences in sheet lengths of the various plies cut by the crosscutter comprising means mounting the web guiding means for pivotable movement as a unit about the axis of one of the two rolls of the feeding means and means for fixing the web guiding means in a selected position in the path of motion thereof.

2. The machine according to claim 1, further comprising a slitter disposed between the web guiding means and the feeding means and wherein the slitter is pivotable together with the web guiding means.

3. The machine according to claim 1 or claim 2, wherein the mounting means comprising two side plates supporting the web guiding means and pivotally connected to the shaft and said one roll.

4. The machine according to claim 3, wherein the fixing means comprises spindle and nut assemblies operatively connected to the side plates.

5. The machine according to claim 4, wherein the crosscutter is a rotary crosscutter.

* * * * *